United States Patent [19]

Young

[11] 4,395,057

[45] Jul. 26, 1983

[54] BOOK HOLDER

[76] Inventor: John W. Young, 260 Overlook Dr., Lancaster, Ohio 43130

[21] Appl. No.: 258,609

[22] Filed: Apr. 29, 1981

[51] Int. Cl.[3] ..... B42D 9/00; B42D 3/16

[52] U.S. Cl. ..... 281/42; 24/129 R; 24/298; 281/45

[58] Field of Search ..... 24/68 CD, 129 R, 129 B, 24/255 R, 255 SL, 265 AL, 298, 300, 301; 281/3 R, 42, 43, 45, 46, 47, 48

[56] References Cited

U.S. PATENT DOCUMENTS

| | | | |
|---|---|---|---|
| 314,436 | 3/1885 | Crocker | 24/300 X |
| 376,062 | 1/1888 | Berry, Jr. | 24/301 |
| 1,196,715 | 8/1916 | Noll | 281/42 |
| 1,209,252 | 12/1916 | Blatt | 281/42 X |
| 1,363,120 | 12/1920 | Johnson | 281/42 |
| 1,665,641 | 4/1928 | Reese | 281/3 R |
| 1,805,191 | 5/1931 | Skripkin | 281/48 |
| 1,809,943 | 6/1931 | Ockenden | 281/42 |
| 2,832,358 | 4/1958 | Chambers | 24/301 X |
| 3,328,064 | 6/1967 | Simon | 24/298 X |
| 4,220,306 | 9/1980 | Cueto et al. | 24/129 R |

*Primary Examiner*—Paul A. Bell

*Attorney, Agent, or Firm*—Frank H. Foster

[57] ABSTRACT

A book holder for comfortably and securely supporting a book with one hand without the aid of an inanimate support platform such as a table and to aid in the carrying of the book. The book holder has a handle means in connection with elastic bands that attach to the ends of the book. Bookmarking strands may be combined with the book holder to mark the user's place.

8 Claims, 8 Drawing Figures

BOOK HOLDER

TECHNICAL FIELD

This invention relates to book supporting devices and more particularly to a device for aiding the hand support of a book both for reading and for carrying.

BACKGROUND ART

While attention has been focused in the past on devices and methods to support books, this has been for the most part, directed to situations where it is desired that the book shall stand or rest upon another inanimate object such as a table, desk, bed, etc. However, in many reading situations there is no readily available or convenient place to put the book down for support. This invention, on the other hand, is directed toward assisting the user/reader in holding the book in his hand. Reading for extended periods of even ten, fifteen or more minutes can be tiresome when the reader is standing such as travelling on a subway.

In addition, there is another problem and that is holding the book open at the proper page. Unless the book is resting on something, reading is a two-handed task, i.e. one hand to support the book and the other hand to hold it open at the proper pages and to turn the page.

Patents of general interest to the subject of book holders are U.S. Pat. Nos. 1,196,715, 1,363,120, 1,665,641 and 1,805,191. The latter patent shows a device which clamps against the spine of a book by passing a strip down through the pages of the book clamping at the top and bottom. In contrast, as well be later described, this invention clamps entirely on the outside of the book.

SUMMARY OF THE INVENTION

Briefly and in summary, the invention is a holder for a book which has opposing covers that are attached at opposite sides to the book spine, the covers having opposite ends. The book holder has a handle constructed to contact the cover of a book in the area of the book spine. The handle has a grasp portion of a size to receive a finger or thumb of a user, and also has at least one additional connection means of a size to receive at least a pair of elastic bands. The elastic bands are connected to the connection means of the handle, the bands having attachment means at each end constructed to fit over the ends of the book cover at the opposite ends. The bands are constructed to have a length, when unattached from the book, which is less than the distance between the opposite ends of the book cover. They are constructed to attach to the book by elastic tension of the bands when the attachment means fit over the ends of the book covers.

This invention greatly facilitates reading a book in situations where there is no convenient place to put the book down making it substantially a one-handed activity. This invention also helps in carrying a book by providing a handle which prevents the book from slipping through the user's fingers.

It is an object of this invention to provide a device which is relatively simple in construction, economical to manufacture of readily available materials which may be economically purchased so that the devicer will have value to the user commensurate with the cost.

A further object is to provide a device which makes it convenient to hold a book without resting it on any other inanimate object, on one hand without difficulty in holding the book open to a certain place. Although providing comfort and ease for anyone, the invention is particularly advantageous for individuals with a hand impairment or handicap.

It is still a further object to provide a device which is of assistance in carrying a book.

Other objects and features of the invention will be apparent from the following drawings and detailed description of the invention and the appended claims.

DETAILED DESCRIPTION OF THE INVENTION

Figure 1:
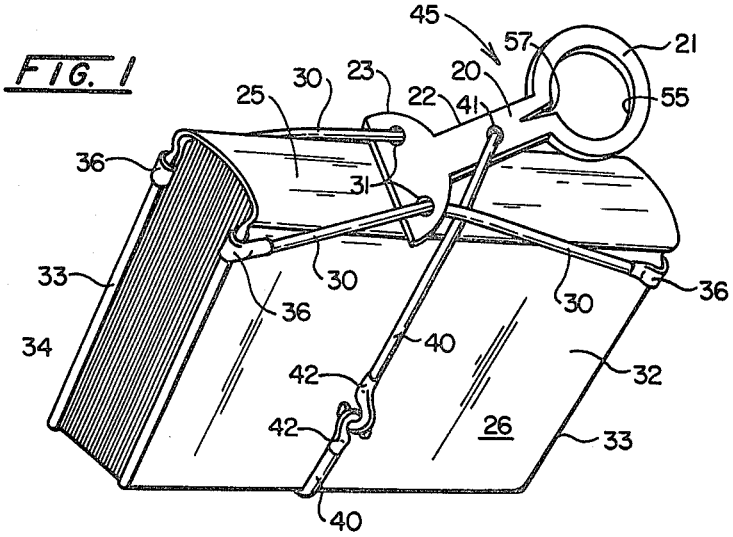
FIG. 1 is a prospective view of the device of this invention assembled in operative position on a closed book.
Figure 2:
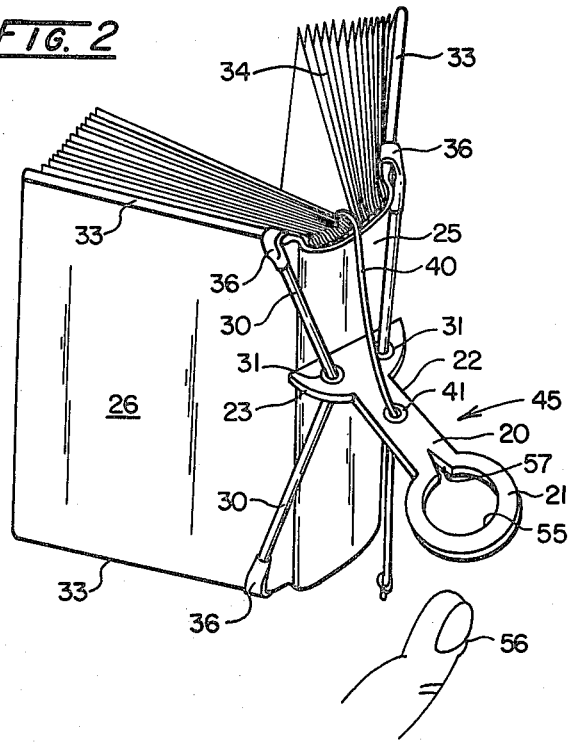
FIG. 2 is a prospective view of the device of this invention in operative position on an open book.

Referring to the drawings where like numerals indicate corresponding parts in the different figures, in FIGS. 1 and 2, a book holder 45 of this invention is shown in position on a book 26. A handle means 20 is formed in an asthetically pleasing configuration of a plate-like material such as plastic or metal. The handle means 20 includes a grasp portion means 21, a body portion 22 and a saddle portion 23. The saddle portion 23 is formed at one end with a contact surface 26 which is formed to rest upon the spine 25 of a book 26. At least two elastic bands 30 are carried by the handle means 20 by a connection means 31, which are shown as apertures in the handle means 20 through which the bands 31 pass.

The book is of conventional construction including covers 32 on opposite sides which are attached to the spine 25. The covers have opposite ends 33 and pages 34 there between. The pages 34 are internally bound to the spine by a conventional means not necessary to the understanding of this invention.

A generally hook-shaped attachment means 36 is provided at each end of the elastic bands 30.

Referring to FIG. 2, a bookmark 40 passes through an aperture 41 in the handle means 20. As in the usual operation of a bookmark, the bookmark 40 passes down between the pages 34 of the book 26 at the place to be marked.

As will be later explained, the bookmark 40 may have various end constructions.

As seen in FIG. 1, if there is no need to mark a place, a bookmark 40, having hooks 42 at opposite ends, may be passed around the sides of the book to hold it closed in a carrying position of the book holder 45.

Figure 3:
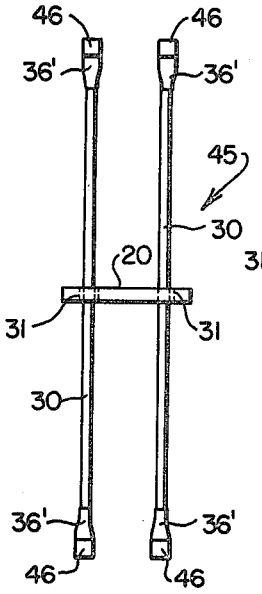
FIG. 3 is a plan view of an embodiment of this invention in assembled position unattached from a book.
Figure 4:
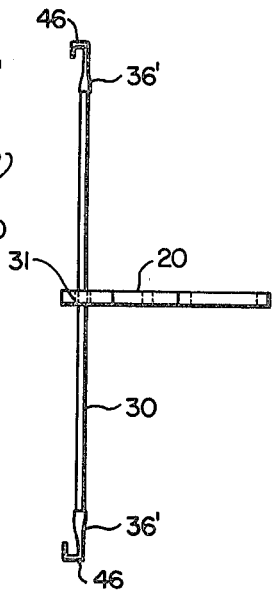
FIG. 4 is a side view of the invention shown in FIG. 3.

Referring to FIGS. 3 and 4, the book holder 45 comprises handle means 20 having elastic bands 30 passing through apertures 31. At each end, the attachment means 36 are separately attached, and are formed with hooks 46 connected to the elastic bands 30.

Various embodiments of bookmarks 40 may be used in combination with the invention.

Figure 5:
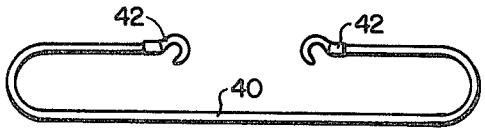
FIG. 5 is one embodiment of a bookmark which may be combined in this invention.

In FIG. 5, a bookmark 40, is shown having hooks 42 at each end which may be used to hook on the ends 33 of the book 26 or may be used to hook onto each other as shown in FIG. 1. In the embodiment of FIG. 5, the bookmark 40 should be madeof an elastic material such as rubber or other elastimer or stretchable fabric.

Figure 6:
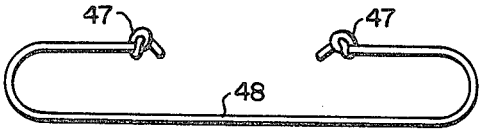
FIG. 6 is another embodiment of a bookmark which may be combined in this invention.

In a very simple form shown in FIG. 6, a bookmark 46 may consist of a strand having a knot 47 at each end.

Figure 7:
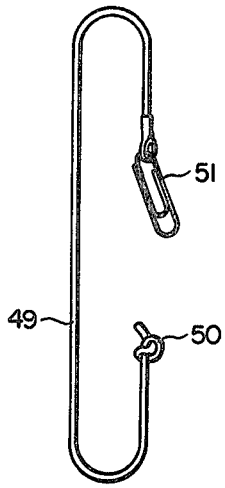
FIG. 7 is still another embodiment of a bookmark which may be combined in this invention.

Referring to FIG. 7, a bookmark 49 comprises a strand having a knot 50 at one end and a clip 51 at the opposite end. The clip 51 can slide over the end of a page 34 in the book 26.

It should be understood that all of the various embodiments of the bookmarks shown in FIGS. 5, 6 and 7 are combined with the book holder 45 by passing them through the aperture 41 in the handle means 20. The bookmarks being thus connected to the book holder 40, they are always readily available for use and will not be misplaced or lost. Bookmarks may be elastic or not, and of any suitable decorative or utilitarian flexible material.

In a like fashion, elastic bands 30 are always available since they are connected to the handle means 20 by passing through the apertures 31.

The handle means may be very inexpensively constructed of molded or die-cut plastic material such as polystyrene or polyethelyne. In some circumstances grommets may be provided around the edges of the apertures 31 and 41 to prevent wear on the bands and bookmark passing through. On the other hand, with suitable selection of materials the handle means may be of a waxy plastic such as polyethelyne and of a thickness such that grommets are not required.

The grasp portion means 21, as shown in FIGS. 1, 2, 3 and 4 comprises an enlarged segment having an aperture 55 through which a user's finger 56 may be inserted as a means to hold and grasp the book holder 45 and the book 26. A 57 is provided to serve as an anchor for the end of a bookmark 40, 48 or 49 to prevent them from dangling.

Figure 8:
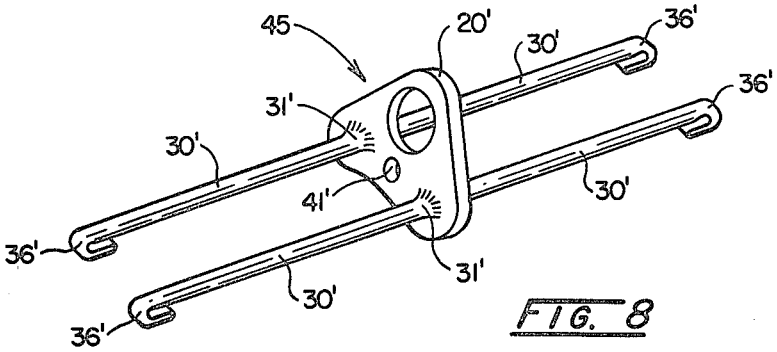
FIG. 8 is a prospective view of still another embodiment of this invention in which the device is constructed of one integral material.

As shown in FIG. 8, in another embodiment of the invention the book holder 45 comprises an integrally molded one-piece unit constructed from an elastic material such as rubber, neoprene, or other elastomer. In this embodiment, the handle means 20' and the elastic bands 30' as well as the attachment means 36' are connected together as integral extensions, one of the other, at the connection means 31'. An aperture 41' is provided for a bookmark (not shown).

As shown in FIGS. 1 and 2 the book holder 45 may be used either to carry the book in closed position (FIG. 1) or to hold the book in open position (FIG. 2). The finger 56 of the user may be inserted in the aperture 55 as a means of grasping the book holder and the book together. Because of the elasticity of the bands 30, the book is clamped in position against the contact surface of the book holder at the spine. The degree to which the book is held open depends upon the position the attachment means 36 along the ends 33. If the attachment means are positioned far out from the spine there is a tendency for the book to be held more open. On the other hand, if the attachment means are close to the spine the force holding the book open is much less.

It is apparent that the book may be held in various positions in one hand of the user.

Although the invention is directed primarily to its use of holding a book in the user's hand, it has been found that by appropriate tensioning and positioning of the elastic bands connected to the handle means, the handle means can be established as a brace to incline the book toward the reader when the book is placed upon a table. This use lends another dimension to the usefulness and utility of the invention.

It will be further seen that the invention is inexpensive to manufacture being composed of commonly found, economically available materials and requiring only a small amount of labor for its manufacture.

It is herein understood that although the present invention has been specifically disclosed with the preferred embodiments and examples, modification and variation of the concepts herein disclosed may be resorted to by those skilled in the art. Such modifications and variations are considered to be within the scope of the invention and the appended claims.

What is claimed is:

1. A holder for a book which has opposing covers attached at opposite sides to a book spine, each cover having in it reading position a top and a bottom edge, the holder comprising:

(a) a handle means constructed to contact the cover of the book on the spine of the book and having a digit receiving opening;

(b) a pair of elastic bands connected to the handle means, each band having attachment means at each end constructed to attach over the opposite top and bottom edges of a different one of said book covers the combined length of each band and its attachment means being less than the distance between the top and bottom edges of said covers when said connection means are detached from the covers and said elastic bands are relaxed and being constructed to attach to the book by elastic tension of the bands when the attachment means fit over the opposite top and bottom edges of the book covers.

2. A holder in accordance with claim 1 wherein each of said bands pass through an aperature formed in said holder.

3. A book holder according to claim 1 wherein the handle means and the elastic bands are molded together in one integral body of elastimer material.

4. A holder for a book which has opposing covers attached to a book spine, each cover having in its reading position, a top and a bottom edge, the holder comprising:

(a) a handle means constructed to contact the cover of the book on the spine of the book and having a grasp means and at least one connection means to receive at least a pair of elastic bands, said handle means also having an additional aperture;

(b) at least a pair of elastic bands connected to the connection means of the handle means, the bands having attachment means at each end constructed to attach over opposite top and bottom edges of each of the book covers, the combined length of each band and its attachment means being less than the distance between the top and bottom edges of said covers when said connection means are detached from the covers and said elastic bands are relaxed and being constructed to attach to the book by elastic tension of the bands when the attachment means fit over the opposite top and bottom edges of the book covers; and (c) a bookmark strand positioned through the additional aperature and of a length sufficient to be passed between the pages of the book as a place mark.

5. A book holder according to claim 4 wherein the bookmark strand is constructed of elastic material and is provided with interconnecting hooks at opposite ends.

6. A book holder according to claim 4 wherein the bookmark is provided with a page clip at an end.

7. A book holder according to claim 4 wherein the handle means is provided with an anchor means to hold the end of the bookmark when not in use as a place mark.

8. A book holder according to claim 7 wherein the anchor means is a notch in a surface of the handle means.

* * * * *